US006070643A

United States Patent [19]

Colvin

[11] Patent Number: 6,070,643

[45] Date of Patent: Jun. 6, 2000

[54] HIGH VACUUM DIE CASTING

[75] Inventor: Gregory N. Colvin, Muskegon, Mich.

[73] Assignee: Howmet Research Corporation, Whitehall, Mich.

[21] Appl. No.: 08/928,842

[22] Filed: Sep. 12, 1997

[51] Int. Cl.[7] ..... B22D 17/14; B22D 27/15

[52] U.S. Cl. ..... 164/61; 164/65; 164/113; 164/256; 164/258

[58] Field of Search ..... 164/61, 62, 65, 164/113, 253, 254, 256, 258, 312

[56] References Cited

U.S. PATENT DOCUMENTS

| | | | |
|---|---|---|---|
| 2,668,985 | 2/1954 | Babbitt . | |
| 2,799,066 | 7/1957 | Federman et al. . | |
| 2,882,570 | 4/1959 | Brennan . | |
| 3,019,495 | 2/1962 | Cornell . | |
| 3,202,409 | 8/1965 | Farrer . | |
| 3,321,008 | 5/1967 | Jones . | |
| 3,863,706 | 2/1975 | Chandley et al. . | |
| 4,055,216 | 10/1977 | Vlyandv et al. . | |
| 4,146,081 | 3/1979 | Reis . | |
| 4,154,286 | 5/1979 | Glazunov et al. . | |
| 4,240,497 | 12/1980 | Glazunov et al. . | |
| 4,478,270 | 10/1984 | Rosenthal et al. . | |
| 4,586,560 | 5/1986 | Ikeya et al. . | |
| 5,119,865 | 6/1992 | Mae et al. . | |
| 5,383,514 | 1/1995 | Taguchi et al. . | |
| 5,531,262 | 7/1996 | Freeman . | |
| 5,860,468 | 1/1999 | Cook | 164/258 X |

FOREIGN PATENT DOCUMENTS

| | | | |
|---|---|---|---|
| 514 829 | 2/1981 | Australia . | |
| 0 790 090 | 8/1997 | European Pat. Off. . | |
| 43 10 755 | 10/1994 | Germany . | |
| 62-207554 | 9/1987 | Japan | 164/253 |
| 64-31562 | 2/1989 | Japan | 164/254 |
| 313426 | 5/1956 | Switzerland | 164/254 |

OTHER PUBLICATIONS

Abstract of Japanese Patent Publication 4–71763 Published Mar. 6, 1992.

*Primary Examiner*—J. Reed Batten, Jr.

[57] ABSTRACT

A metal or alloy is melted in a vaccuum chamber disposed about an end of a shot sleeve. The opposite end of the shot sleeve is communicated to a die cavity between first and second dies which are disposed in ambient air atmosphere. The dies have one or more vacuum seals therebetween extending about the die cavity to isolate the die cavity from the ambient air atmosphere when the dies are closed. A vacuum thereby is provided in the die cavity through the shot sleeve when the vacuum chamber is evacuated despite the dies being disposed in ambient air atmosphere. The first and second dies are opened after the metal or alloy is die cast in the die cavity for ready removal of the cast component from the die cavity directly to the ambient air atmosphere and then to an optional quenchant medium proximate the dies.

33 Claims, 3 Drawing Sheets

HIGH VACUUM DIE CASTING

FIELD OF THE INVENTION

The present invention relates to die casting of metals and alloys and, more particularly, to vacuum die casting of metals and alloys under relatively high vacuum die cavity conditions.

BACKGROUND OF THE INVENTION

Titanium, titanium based alloy, nickel based alloy, and stainless steel castings are used in large numbers in the aerospace industry. Many such castings are made by the well known investment casting process wherein an appropriate melt is cast into a preheated ceramic investment mold formed by the lost wax process. Although widely used, investment casting of complex shaped components of such reactive materials can be characterized by relatively high costs and low yields. Low casting yields are attributable to several factors including surface or surface-connected, void type defects and/or inadequate filling of certain mold cavity regions, especially thin mold cavity regions, and associated internal void, shrinkage and like defects.

Lower cost casting of reactive metals and alloys such as titanium and titanium and nickel based alloys using permanent, reusable, multi-part metal molds based on iron and titanium is described in Colvin U.S. Pat. No. 5,287,910. Casting of aluminum, copper, and iron based castings using permanent metal molds is described in U.S. Pat. No. 5,119,865.

It is an object of the present invention to provide die casting apparatus and method for casting metals and alloys, especially metals and alloys reactive to oxygen, under relatively high vacuum die cavity conditions.

It is another object of the present invention to provide die casting apparatus and method for casting metals and alloys under relatively high vacuum die cavity conditons followed by removal of the die cast components from the dies to the ambient atmosphere and quenching of the components in a quenchant medium proximate the dies.

SUMMARY OF THE INVENTION

The present invention provides apparatus and method for die casting a metal or alloy wherein the metal or alloy is melted in a vacuum chamber disposed about an end of a shot sleeve. The shot sleeve includes an opposite end communicated to a die cavity defined between first and second dies that are located outside the vacuum chamber in ambient air atmosphere. One or more high temperature vacuum seals is/are provided between the dies about the die cavity such that a vacuum is provided in the die cavity through the shot sleeve when the vacuum chamber is evacuated. The first and second dies are opened after the metal or alloy is die cast in the die cavity followed by removal of the cast component from the die cavity directly to the ambient atmosphere or to an optional quenchant medium proximate the dies.

The present invention envisions in one embodiment evacuating the die cavity to a vacuum level of less than 1000 microns through the shot sleeve, introducing a reactive molten metal or alloy, such as a titanium, titanium based alloy, nickel based superalloy, and iron based alloy, into the shot sleeve in the vacuum melting chamber preferably in an amount that occupies less than 40 volume %, such as about 8 to about 15 volume %, of the effective internal shot sleeve volume, and then advancing the plunger to inject the reactive molten metal or alloy into the sealed, evacuated die cavity where at least the outer surface of the cast component can solidify before opening of the dies to break the vacuum seal (s) and expose the cast component to ambient air atmosphere for removal from the die and optional quenching in a quenchant medium.

The present invention envisions in another embodiment placing a plug in the shot sleeve prior to introduction of the metal or alloy located downstream of the shot sleeve melt inlet such that the plug improves filling of the shot sleeve with the proper volume of molten metal or alloy needed to fill the die cavity. The plug is advanced toward the die cavity as the plunger pressure injects the molten metal or alloy in the die cavity. The plug is moved by advancement of the plunger into a plug-receiving chamber out of the way of the die cavity so as not to interfere with injection of the molten metal or alloy in the die cavity.

In the die casting of an oxygen reactive molten metal or alloy having a melting point greater than about 2000 degrees F., the shot sleeve and the plunger, or optional disposable plunger tip, contacting the molten metal or alloy can be made of an iron based material, such as H-13 tool steel, a refractory material such as Mo based alloy or TZM alloy, ceramic material such as alumina, or combinations thereof.

Details of the present invention will become more readily apparent from the following detailed description taken with the following drawings.

DETAILED DESCRIPTION OF THE INVENTION

Figure 1:
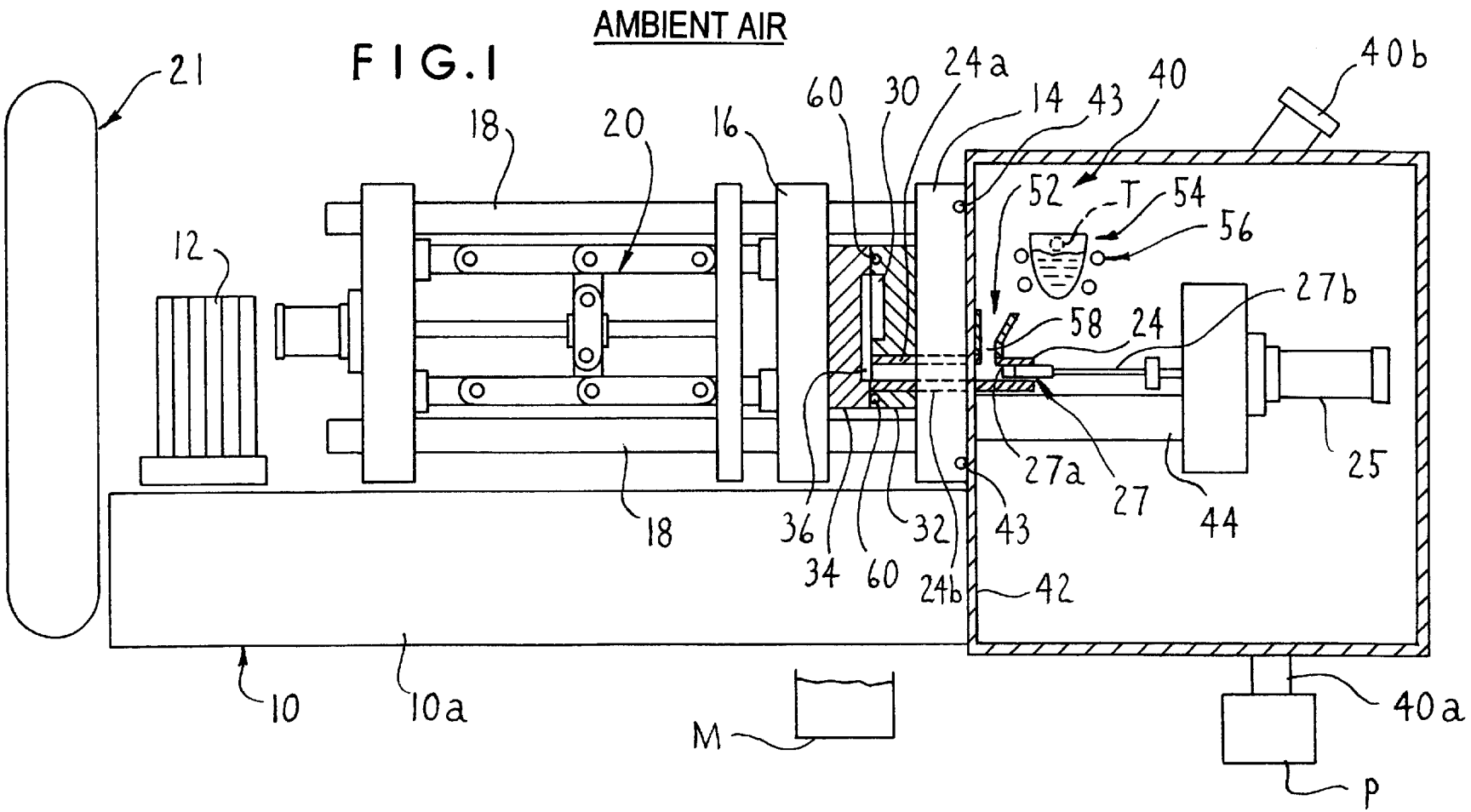
FIG. 1 is a side elevation, partially in section, of die casting apparatus for practicing an embodiment of the present invention with the shot sleeve vacuum chamber shown broken away.
Figure 2:
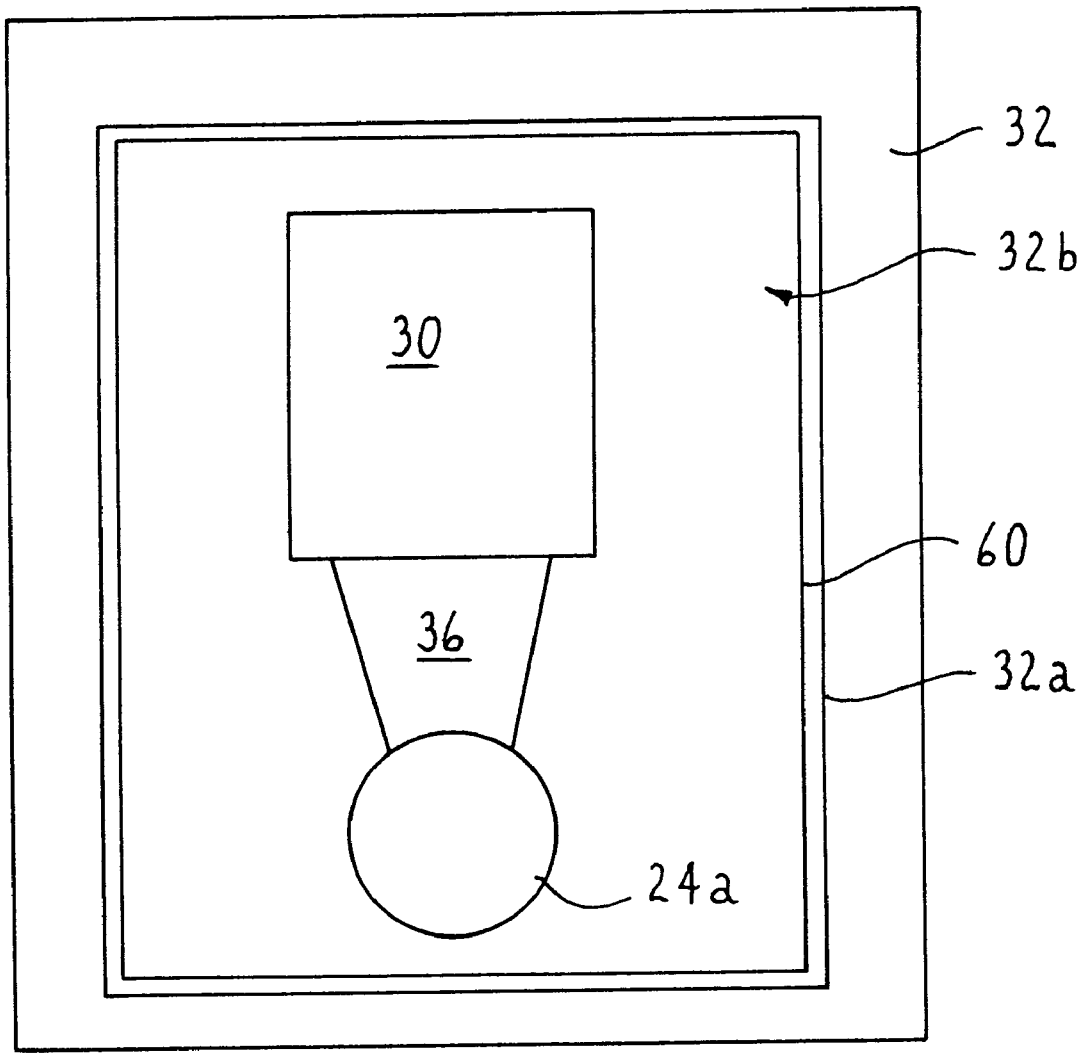
FIG. 2 is an enlarged elevational view of the stationary die showing a vacuum O-ring seal disposed in a groove in the die to seal against the other die when the dies are closed to isolate the die cavity from ambient air atmosphere.

Referring to FIGS. 1–2, die casting apparatus in accordance with an embodiment of the present invention is shown for die casting a metal or alloy such as especially titanium and titanium based alloys that are highly reactive with oxygen, under relatively high vacuum conditions in the die cavity despite the dies being disposed exteriorly in ambient air atmopshere. The apparatus also can be used to die cast nickel, cobalt base and other superalloys, iron based alloys such as stainless steels, and other metals or alloys under relatively high vacuum conditions in the die cavity.

The die casting apparatus comprises a base 10 which defines therein a reservoir 10*a* for hydraulic fluid that is used by hydraulic actuator 12 to open and close the fixed and movable die platens 14, 16. The platen 16 is disposed for movement on stationary tie bars or rods 18 and has a die 34 disposed thereon. A die clamping linkage mechanism 20 is connected to the movable die platen 16 in conventional manner not considered part of the present invention to open/close the movable die 34 relative to fixed die 32 disposed on platen 14. For example, a conventional die casting machine available as 250 ton HPM #73-086 from HPM, Cleveland, Ohio, includes such a base 10, actuator 12, and die platens 14, 16 mounted on tie bars 18 and opened/closed by die clamping linkage mechanism 20 in the manner described. The die casting machine includes a gas accumulator 21 for rapid feeding of hydraulic fluid to the plunger mechanism.

The die casting apparatus comprises a tubular, horizontal shot sleeve 24 that communicates to a die cavity 30 defined, the dies 32, 34 disposed on the respective die platens 14, 16. One or more die cavities can be formed by dies 32, 34 to die cast one or more components. The shot sleeve 24 has an discharge end section 24*a* that communicates with the entrance passage or gate 36 to the one or more die cavities 30 so that molten metal or alloy can be pressure injected therein. The entrance passage or gate 36 can be machined in the stationary die 32 or the movable die 34, or both.

The discharge end section 24*a* of the shot sleeve 24 extends through a suitable passage 24*b* in the stationary platen 14 and die 32 as illustrated in FIG. 1.

The shot sleeve 24 extends through die 32 into a vacuum melting chamber 40 where the metal or alloy to be die cast is melted under relatively high conditions such as less than 1000 microns required by titanium and its alloys, such as Ti-6Al-4V, which are highly reactive to oxygen in ambient air at elevated temperatures. The vacuum chamber 40 is defined by a vacuum housing wall 42 that extends about and encompasses or surrounds the opposite charging end section of the shot sleeve 24 receiving the plunger 27 and the plunger hydraulic actuator 25. The vacuum chamber 40 is evacuated by a conventional vacuum pump P connected to the chamber 40 by a conduit 40*a*. The base 10 and the vacuum housing wall 42 rest on a concrete floor or other suitable support.

The chamber wall 42 is airtight sealed with the fixed platen 14 by a peripheral airtight seal(s) 43 located therebetween so as to sealingly enclose the shot sleeve 24 and a pair of side-by-side stationary, horizontal shot sleeve/plunger support members 44 (one shown) extending through chamber wall 42. Such shot sleeve/plunger support members are provided on the aforementioned conventional die casting machine (250 ton HPM #73-086).

A plunger 27 is disposed in the shot sleeve 24 for movement by plunger acutator 25 and plunger connector rod 27*b* between a start injection position located to the right of a melt entry or inlet opening 58 in shot sleeve 24 and a finish injection position proximate the die entrance gate 36. The melt inlet opening 58 communicates to a metal (e.g. steel) melt-receiving vessel 52 mounted adjacent the fixed platen 14 on the shot sleeve 24 by clamps, such as screw clamps (not shown). The melt-receiving vessel 52 is disposed beneath a melting crucible 54 to receive a charge of molten metal or alloy therefrom for die casting.

The melting crucible 54 may be a conventional induction skull crucible comprising copper segements in which a charge of solid metal or alloy to be die cast is charged via vacuum port 40*b* and melted by energization of induction coils 56 disposed about the crucible in conventional manner in the chamber 40. Known ceramic or refractory lined crucibles also can be used in practicing the present invention. The crucible 54 can be tilted by rotation about crucible trunnions T using a conventional hydraulic, electrical or other actuator (not shown) disposed outside the vacuum chamber 40 and connected to the crucible by a suitable vacuum sealed linkage extending from the actuator to the crucible. The crucible is tilted to pour the molten metal or alloy charge into the melt-receving vessel 52, which is communicated to the shot sleeve 24 via opening 58 in the shot sleeve wall. The molten metal or alloy charge is introduced through opening 58 into the shot sleeve 24 in front of the plunger tip 27*a*.

In practicing an embodiment of the present invention, the molten metal or alloy charge is introduced into the shot sleeve in an amount that is less than 40 volume % of the effective internal volume of the shot sleeve defined in front of the plunger tip 27*a* and extending to the entrance or gate 36 of the die cavity. Preferably the amount of molten metal or alloy occupies less than 20 volume %, and even more preferably from about 8 to about 15 volume %, of the effective internal volume of the shot sleeve. Such a relatively low volume of molten charge relative to the shot sleeve internal volume provides a relatively low molten charge profile in the shot sleeve (i.e. the molten charge lies more along the bottom of the shot sleeve) to thereby reduce the contact area and contact time of the high temperature molten charge with the plunger tip 27*a* and resultant swelling of the plunger tip prior to melt injection into the mold cavity.

The plunger 27 is moved from the start injection position to the finish injection position by a conventional hydraulic actuator 25 that, for example, is provided on the aforementioned conventional die casting machine (250 ton HPM #73-086). Typical plunger speeds are in the range of 50 to 300 feet/second. Radial clearances between the shot sleeve 24 and the plunger tip 27*a* are in the range of about 0.0005 inch to 0.020 inch. A preferred radial clearance between the shot sleeve 24 and the plunger tip 27*a* is about 0.008 inch.

In die casting titanium, titanium based alloys, nickel base superalloys, and iron based alloys, the shot sleeve 24 and forward plunger tip 27*a* contacting the molten metal or alloy can be made of an iron based material, such as H-13 tool steel, or a refractory material such as based on Mo alloy or TZM alloy, ceramic material such as alumina, or combinations thereof that are compatible with the metal or alloy being melted and die cast. The plunger tip 27*a* can comprise a disposable tip that is thrown away after each molten metal or alloy charge is injected in the die cavity 30. A disposable plunger tip can comprise a copper based alloy such as a copper-beryllium alloy (e.g. D340 alloy), which is especially suitable for die casting A380 aluminum alloy.

In die casting titanium, titanium based alloys, nickel base superalloys, and iron based alloys, the dies 32, 34 can be made of steel and/or titanium pursuant to Colvin U.S. Pat. No. 5,287,910, although other die materials may be used in practicing the invention.

Referring to FIG. 1, the first and second dies 32, 34 are disposed outside the vacuum melting chamber 40 in ambient air atmosphere. That is, exterior surfaces or sides of the dies 32, 34 are exposed to ambient air atmosphere.

Pursuant to the present invention, when the dies 32, 34 are closed, the die cavity 30 defined therebetween is communicated to the vacuum chamber 40 via the shot sleeve 24 and can be evacuated through the shot sleeve.

The stationary die 32 typically includes one or more grooves 32*a* on its inner face 32*b* (one groove shown in FIG. 2) that mates with the opposing inner face of the movable die 34 when the dies are closed. The groove(s) 32*a* encircle or extend about the die cavity 30 as well as gate 36 and a melt discharge opening commuicated to gate 36 and defined by shot sleeve end 24*a*. The groove 32*a* receives a resilent, reusable high temperature O-ring vacuum seal 60 for sealing in vacuum tight manner against the mating face of the movable die 34 when the dies are closed. Alternately, the seal(s) 60 can be disposed in grooves on the mating face of the movable die 34, or they can be disposed on the mating faces of both dies 32, 34, so as to form a vacuum tight seal about and isolating the die cavity 30, gate 36 and shot sleeve end 24*a* from the ambient air atmosphere surrounding the exterior of the dies 32, 34 when closed. A series of several grooves and O-ring seals can be provided progressively outwardly relative to the die cavity perimeter to form a plurality of vacuum tight seals. The vacuum seals 60 may comprise Viton material that can withstand temperatures as high as 400 degrees F. that may be present when the die cavity 30 is filled with molten metal or alloy.

By use of vacuum seals 60, the die cavity 30 is isolated from the ambient air atmosphere when the dies 32, 34 are closed and enables the die cavity 30 to be evacuated through the shot sleeve 24 when the vacuum melting chamber 40 is evacuted to high vacuum levels of less than 1000 microns employed for melting the solid charge in the crucible 54.

In operation of the die casting apparatus of FIG. 1, a solid metal or alloy is charged into the crucible 54 in the vaccuum melting chamber 40 via port 40*b*. The vacuum chamber 40 then is evacuated to a suitable level for melting the particular charge (such as less than 100 microns; e.g. 90 microns, for titanium and its alloys such as Ti-6Al-4V alloy, nickel base superalloys, and stainless steels) by vacuum pump P. The die cavity 30 formed by the closed dies 32, 34 is concurrently evacuated to the same vacuum level through the connection to the vacuum melting chamber 40 via the shot sleeve 24 and by virtue of being isolated from surrounding ambient atmosphere by the vacuum seal(s) 60.

The molten charge of the metal or alloy in crucible 54 is poured under vacuum into the shot sleeve 24 via the vessel 52 and melt inlet opening 58 with the plunger 27 initially positioned at the start injection position of FIG. 1. As mentioned above, the molten metal or alloy charge is introduced into the shot sleeve in an amount that is less than 40 volume % of the effective internal volume of the shot sleeve. Preferably the amount of molten metal or alloy occupies less than 20 volume %, and even more preferably from about 8 to about 15 volume %, of the effective internal volume of the shot sleeve. The molten metal or alloy is poured into the shot sleeve 24 and resides therein for a preselected dwell time of between 0.005 seconds and 4 seconds, typically only 0.1 second to 1.5 seconds, for the purpose of insuring that no molten metal gets behind the plunger 27. The melt can be poured directly from the crucible 54 via vessel 52 into the shot sleeve 24, thereby reducing time and metal cooling before injection can begin.

The plunger 27 then is advanced in the shot sleeve 24 by actuator 25 to pressure inject the molten metal or alloy into the die cavity 30 via entrance passage or gate 36. The molten metal or alloy is forced at high velocities, such as up to 150 inches per second, down the shot sleeve 24 and into sealed, evacuated die cavity 30.

After the molten metal or alloy has been injected, the dies 32, 34 are opened by movement of die 34 relative to die 32 within a typical time period that can range from 5 to 25 seconds following injection to provide enough time for the molten metal or alloy to form at least a solidified surface on the die cast component(s). The dies 32, 34 then are opened to allow ready removal of the die cast component(s) from the dies. A conventional ejector pin mechanism (not shown) provided on the aforementioned HPM die casting machine and not forming a part of the invention helps eject the die cast component(s) from the dies. Removal of the die cast component(s) can be made directly from the dies 32, 34 simply by opening the dies without further cooling of the cast component(s). This is advantageous to increase production output of die cast components. When the dies are opened, the vacuum seal(s) 60 is/are broken, and the cast component(s) is/are exposed to ambient air atmosphere and optionally can be quenched in a quenchant medium M, such as water, oil and the like, located proximate the open dies 32, 34.

Figure 3:
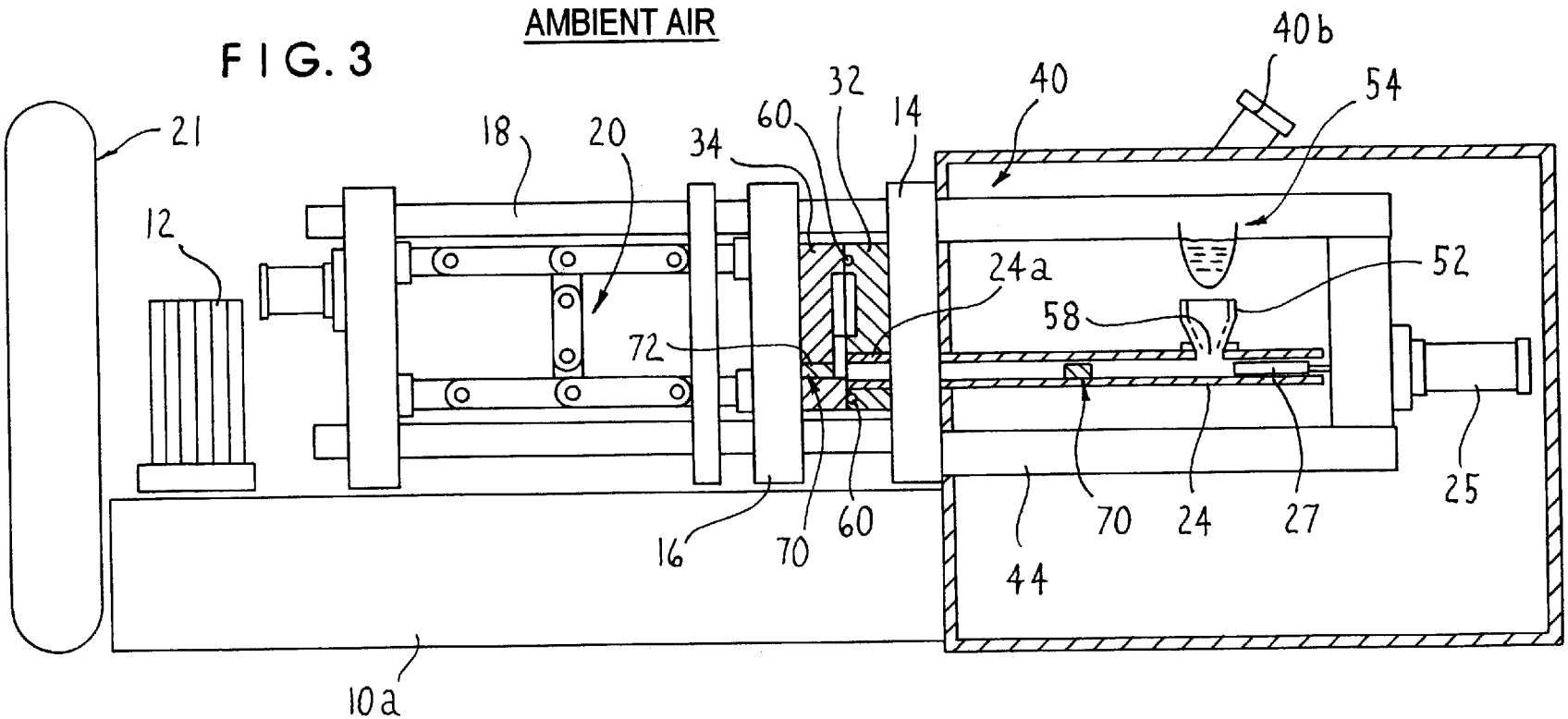
FIG. 3 is a side elevation, partially in section, of another die casting apparatus for practicing another embodiment of the present invention wherein a floating plug is positioned in a longer shot sleeve prior to introduction of molten metal or alloy therein.

Referring to FIG. 3 wherein like or similar features are represented by like reference numerals, the present invention envisions in another embodiment placing a floating plug 70 in a longer shot sleeve 24 prior to introduction of the metal or alloy from crucible 54. The plug 70 initially is located downstream of the melt inlet opening 58 to improve filling of the shot sleeve 24 between the plug 70 and the plunger tip 27*a* with the proper volume of molten metal or alloy needed to fill the die cavity 30.

The plug 70 is advanced toward the die cavity 30 as the plunger 27 pressure injects the molten metal or alloy in the die cavity 30. The plug 70 is moved by advancement of the plunger 27 into a plug-receiving chamber 72 formed in the movable die 34 out of the way of the die cavity entrance passage 36 so as not to interfere with injection of the molten metal or alloy in the die cavity. The plug 70 can comprise steel for titanium and its alloys and other high melt temperature metal which is resistant to reaction with the particular molten metal being die cast. The plug 70 is dimensioned such that it will stay in place during sleeve filling with molten metal from the vessel 52 and remain ahead of the injected metal until it rests in chamber 72.

In practicing the embodiments of the invention described above, the temperature of the dies 32, 34 can be controlled within desired ranges to provide die temperatures in the range of 100–700 degrees F. For example, the dies 32, 34 can be preheated prior to the start of injection of molten metal or alloy there by one or more conventional gas flame burners or electrical resistance heating wires operably associated with the dies to this end. The dies 32, 34 can be cooled by water cooling conduits (not shown) formed internally of the dies and through which coolng water is circulated to control die temperature as die cast components continue to be made and the dies heat up. The shot sleeve 24 similarly also optionally can be heated or cooled to control shot sleeve temperature within a desired range such as 100–700 degrees F. by similar gas flame burners or electrical resistance wires or water cooling passages in the shot sleeve.

For die casting of Ti and titanium alloy parts pursuant to an embodiment of the present invention, a charge of molten titanium or an alloy thereof, such as Ti-6Al-4V, comprising from 5 to 10 pounds of melt at a melt temperature typically equal to the metal or alloy melting point plus 50 degrees F. (e.g. about 3080 degrees F. for Ti-6Al-4V) can be introduced into shot sleeve 24 having a length of 16.5 inches and diameter of 3 inches. The molten charge occupies about 9–10 volume % of the effective internal volume of shot sleeve 24, which includes therein a copper-berylium plunger tip having a radial clearance of 0.002 inch with the shot sleeve. The plunger moves at a minimum of 125 inches per second to inject the charge into the die cavity defined between the dies 32, 34 which can be preheated to 300 degrees F. Nickel base superalloys can be die cast pursuant to the invention using similar parameters with a melt temperature equal to the alloy melting point plus 75 degrees F. Stainless steel 17-4 PH can be die cast pursuant to the invention using similar parameters with a melt temperature equal to the alloy melting point plus 25 degrees F.

The invention can be used to die cast complex shaped or configured components such as gas turbine compressor vanes and blades made of nickel base superalloys, such as for example only IN 718 nickel base superalloy, for the compressor section of a gas turbine engine as well as golf club putters made of stainless steel, such as 17-4 PH stainless steel and amorphous alloys, as well as a wide variety of other components.

While the invention has been described in terms of specific embodiments thereof, it is not intended to be thereto but rather only to the extent set forth in the following claims.

What is claimed is:

1. Die casting apparatus, comprising:

a) first and second dies that are disposed in ambient air atmosphere and define a die cavity therebetween when the dies are closed, including a vacuum seal between said dies to isolate said die cavity from the ambient air atmosphere when said dies are closed, b) a shot sleeve communicated to the die cavity and having a melt inlet communicated to a vacuum chamber, c) a melting vessel disposed in the vacuum chamber for melting a metal or alloy that is introduced through said melt inlet into said shot sleeve ahead of a plunger that is movable in said shot sleeve, d) means for evacuating the vacuum chamber to less than 1000 microns when the metal or alloy is melted in said melting vessel such that said die cavity is concurrently evacuated through said shot sleeve by virtue of said die cavity being isolated from the ambient air atmosphere by said vacuum seal, e) said plunger being movable in said shot sleeve to inject the melted metal or alloy into said die cavity, and f) said dies being opened after the melted metal or alloy is injected therein to permit removal of a die cast component from the die cavity directly into the ambient air atmosphere.

2. The apparatus of claim 1 wherein said vacuum seal comprises O-ring seal on at least one die and extending about the die cavity, a gate and a melt discharge opening communicated to said gate.

3. The apparatus of claim 1 wherein said means for evacuating said vacuum chamber provides a vacuum of less than 100 microns in said chamber and said die cavity.

4. The apparatus of claim 1 wherein radial clearance between the plunger and shot sleeve is between about 0.0005 inch and 0.020 inch.

5. The apparatus of claim 1 wherein said melting vessel introduces a charge of the molten metal or alloy that occupies less than 40 volume % of the effective internal volume of the shot sleeve.

6. The apparatus of claim 5 wherein the charge of the molten metal or alloy occupies about 8 to about 15 volume % of the effective internal volume of the shot sleeve.

7. The apparatus of claim 1 further including a plug disposed in said shot sleeve downstream of said melt inlet, said plug being moved by plunger movement through said shot sleeve toward said die cavity.

8. The apparatus of claim 7 wherein one of said dies includes a chamber for receiving said plug when said molten metal or alloy is injected in said die cavity.

9. The apparatus of claim 1 wherein said shot sleeve and said plunger comprise a material selected from the group consisting of an iron based material, a refractory material, and ceramic material and combinations thereof.

10. The apparatus of claim 1 wherein said plunger includes a disposable plunger tip.

11. The apparatus of claim 11 wherein the plunger tip comprises a copper based alloy.

12. The apparatus of claim 1 including means for controlling the temperature of at least one of said dies and said shot sleeve.

13. The apparatus of claim 1 wherein said vessel is disposed adjacent a fixed die platen.

14. Die casting apparatus, comprising:

a) first and second dies that are disposed in ambient air atmosphere and define a die cavity therebetween when the dies are closed, including a vacuum seal between said dies to isolate said die cavity from the ambient air atmosphere when said dies are closed, b) a shot sleeve communicated to the die cavity and having a melt inlet communicated to a vacuum chamber, c) a melting vessel disposed in the vacuum chamber for melting a metal or alloy that is introduced through said melt inlet into said shot sleeve ahead of a plunger that is movable in said shot sleeve, said charge occupying less than 40 volume % of the effective internal volume of said shot sleeve, d) means for evacuating the vacuum chamber when the metal or alloy is melted in said melting vessel such that said die cavity is concurrently evacuated through said shot sleeve by virtue of said die cavity being isolated from the ambient air atmosphere by said vacuum seal, e) said plunger being movable in said shot sleeve to inject the melted metal or alloy into said die cavity, and f) sails dies being opened after the melted metal or alloy is injected therein to permit removal of a die cast component from the die cavity directly into the ambient air atmosphere.

15. The apparatus of claim 14 wherein the charge occupies about 8 to about 15 volume % of the effective internal volume of said shot sleeve.

16. Die casting apparatus, comprising:

a) first and second dies that are disposed in ambient air atmosphere and define a die cavity therebetween, when the dies are closed, including a vacuum seal between said dies to isolate said die cavity from the ambient air atmosphere when said dies are closed, b) a shot sleeve communicated to the die cavity and having a melt inlet communicated to a vacuum chamber, c) a plunger disposed for movement in said shot sleeve, d) a plug disposed in said shot sleeve between said plunger and said die cavity and movable in said shot sleeve toward said die cavity in response to movement of said plungers, e) a melting vessel disposed in the vacuum chamber for melting a metal or alloy that is introduced through said melt inlet into said shot sleeve between said plunger and said plug, d) means for evacuating the vacuum chamber when the metal or alloy is melted in said melting vessel such that said die cavity is concurrently evacuated through said shot sleeve by virtue of said die cavity being isolated from the ambient air atmosphere by said vacuum seal, e) said plunger being movable in said shot sleeve to inject the melted metal or alloy into said die cavity, and f) said dies being opened after the melted metal or alloy is injected therein to permit removal of a die cast component from the die cavity directly into the ambient air atmosphere.

17. The apparatus of claim 16 wherein one of said dies includes a chamber for receiving said plug when said charge is injected into said die cavity by movement of said plunger.

18. A method of die casting a reactive metal or alloy, comprising:

a) melting a reactive metal or alloy in a vacuum chamber communicated by a shot sleeve to a die cavity defined by dies disposed in ambient air atmosphere, b) evacuating the vacuum chamber and the die cavity through the shot sleeve while sealing the die cavity from ambient air atmosphere by vacuum seal means between said dies, c) introducing the melted reactive metal or alloy into the shot sleeve ahead of a plunger in an amount less than 40 volume % of the effective internal volume of the shot sleeve, d) advancing the plunger toward the die cavity to inject the melted reactive metal or alloy into the sealed, evacuated die cavity to form a die cast component, and e) opening the sealed dies to permit removal of the die cast component from the die cavity directly to ambient air atmosphere.

19. The method of claim 18 wherein the reactive metal or alloy is selected from the group consisting of titanium, titanium alloy, superalloy, and stainless steel.

20. The method of claim 18 including the additional step of quenching the die cast component in a quenchant medium after removal from the dies.

21. The method of claim 18 wherein the melted reactive metal or alloy is introduced into the shot sleeve in an amount less than about 20 volume % of the effective internal volume of the shot sleeve.

22. The method of claim 18 wherein the melted reactive metal or alloy is introduced into the shot sleeve in an amount of about 8 to about 15 volume % of the effective internal volume of the shot sleeve.

23. The method of claim 18 including placing a plug in the shot sleeve ahead of the plunger prior to introduction of the melted metal or alloy and advancing the plug toward the dies with the melted metal or alloy between said plug and said plunger.

24. The method of claim 23 including advancing the plug into a chamber formed in one of said dies in a manner not to interfere with injection of the melted metal or alloy in the die cavity.

25. The method of claim 18 wherein the vacuum chamber and the die cavity are evacuated to less than 1000 microns when the reactive metal or alloy is selected from oxygen reactive titanium and titanium based alloy.

26. The method of claim 18 wherein the vacuum chamber and die cavity are evacuated to less than 100 microns.

27. A method of die casting titanium or an alloy thereof, comprising a) melting titanium or an alloy thereof in a vacuum chamber communicated to a die cavity by a shot sleeve to form a melt, evacuating the vacuum chamber and the die cavity through the shot sleeve to less than 1000 microns while sealing the die cavity from ambient air atmosphere by vacuum seal means between dies defining said die cavity, b) introducing the melt into the shot sleeve in an amount less than about 20 volume % of the effective internal volume of the shot sleeve, c) advancing the plunger toward the die cavity to pressure inject the melt into the sealed, evacuated die cavity to form a die cast component, and d) opening the dies to remove the die cast component from the die cavity directly to ambient air atmosphere.

28. The method of claim 27 wherein the melt is introduced into the shot sleeve in an amount of about 8 to about 15 volume % of the effective internal volume of the shot sleeve.

29. A method of die casting a metal or alloy, comprising:

a) melting a metal or alloy in a vacuum chamber communicated by a shot sleeve to a die cavity defined by die means disposed in ambient atmosphere, b) evacuating the vacuum chamber and the die cavity through the shot sleeve to less than 1000 microns while sealing the die cavity from ambient atmosphere by vacuum seal means, c) introducing the melted metal or alloy into the shot sleeve ahead of a plunger, d) advancing the plunger toward the die cavity to inject the melted metal or alloy into the sealed, evacuated die cavity to form a die cast component, and e) opening the sealed die cavity to permit removal of the die cast component therefrom.

30. The method of claim 29 wherein the metal or alloy is introduced into the shot sleeve in an amount less about 40 volume % of the effective internal volume of the shot sleeve.

31. The method of claim 30 wherein the metal or alloy is introduced into the shot sleeve in an amount less than about 20 volume % of the effective internal volume of the shot sleeve.

32. The method of claim 29 including quenchng the die cast component in a quenchant medium after removal from the die means.

33. The method of claim 29 wherein the vacuum chamber and die cavity are evacuated to less than 100 microns.

* * * * *